US009441508B2

(12) United States Patent
Weber et al.

(10) Patent No.: US 9,441,508 B2
(45) Date of Patent: Sep. 13, 2016

(54) CAMSHAFT ADJUSTER

(71) Applicant: Schaeffler Technologies GmbH & Co. KG, Herzogenaurach (DE)

(72) Inventors: Juergen Weber, Erlangen (DE); Dirk Heintzen, Weisendorf (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 14/430,491

(22) PCT Filed: May 29, 2013

(86) PCT No.: PCT/EP2013/061037
§ 371 (c)(1),
(2) Date: Mar. 23, 2015

(87) PCT Pub. No.: WO2014/048588
PCT Pub. Date: Apr. 3, 2014

(65) Prior Publication Data

US 2015/0211389 A1 Jul. 30, 2015

(30) Foreign Application Priority Data

Sep. 26, 2012 (DE) ..... 10 2012 217 393

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01)

(58) Field of Classification Search
CPC ..... F01L 1/344; F01L 1/3442
USPC ..... 123/90.17
See application file for complete search history.

(56) References Cited

U.S. PATENT DOCUMENTS

| | | | | |
|---|---|---|---|---|
| 6,405,695 | B2 * | 6/2002 | Mizutani | F01L 1/3442 123/90.17 |
| 7,444,254 | B2 * | 10/2008 | Tsukada | F01L 1/34409 123/90.15 |
| 2001/0045195 | A1 | 11/2001 | Neller | |
| 2010/0116233 | A1 | 5/2010 | Weisser et al. | |
| 2010/0154732 | A1 | 6/2010 | Bayrakdar | |
| 2012/0318222 | A1 | 12/2012 | Weber | |
| 2013/0324269 | A1 | 12/2013 | Janitschek et al. | |
| 2013/0327288 | A1 | 12/2013 | Boese | |

FOREIGN PATENT DOCUMENTS

| | | |
|---|---|---|
| DE | 10024760 | 12/2001 |
| DE | 10 2008 051755 | 4/2010 |
| DE | 10 2010 009394 | 9/2011 |
| DE | 10 2010 051 052 | 5/2012 |
| DE | 10 2011 003769 | 8/2012 |
| EP | 1 865 158 | 12/2007 |
| EP | 1979582 | 10/2008 |
| EP | 2 184 450 | 5/2010 |
| WO | WO 2007/082600 | 7/2007 |

* cited by examiner

*Primary Examiner* — Zelalem Eshete
(74) *Attorney, Agent, or Firm* — Davidson, Davidson & Kappel, LLC

(57) ABSTRACT

A camshaft adjuster having a stator drivable by a crankshaft, and a rotor which can be rotationally fixedly connected to a camshaft and having a plurality of vanes projecting radially outward from a radially inner ring, and a torsion spring acting between the rotor and the stator and having spiral turns, which is connected to the rotor by a first radially inner spring end, and to the stator by a second radially outer spring end, and arranged at an axial end of the rotor and of the stator and is secured by a securing part covering the turns laterally toward the outer side, wherein on the rotor, in a radially inner section of the vanes axially projecting pins are provided, arranged on a radially inner section of the rotor and, on the radially inner side of the innermost turn, projecting through the torsion spring.

8 Claims, 1 Drawing Sheet

CAMSHAFT ADJUSTER

The present invention relates to a camshaft adjuster.

BACKGROUND

A generic camshaft adjuster is known, for example from EP 1 979 582 B1. In its basic configuration, the camshaft adjuster includes a stator which is drivable by a crankshaft and a rotor which is rotatably fixedly connected to the camshaft. An annular space is provided between the stator and the rotor, which is divided into a plurality of working chambers by projections which are rotatably fixedly connected to the stator and project radially to the inside, the working chambers each being divided into two pressure chambers by a vane which projects radially outward from the rotor. Depending on the application of a pressure medium to the pressure chambers, the rotor is adjusted with respect to the stator, and the camshaft is adjusted with respect to the crankshaft, in the "advance" or "retard" direction. The pressure buildup of the pressure medium also takes place via the crankshaft, as a result of which only a low pressure medium flow is provided at low rotational speeds. This low pressure medium flow has the disadvantage that, under unfavorable conditions, an undesirable adjustment of the camshaft adjuster may occur, which may subsequently result in an unfavorable operating behavior of the internal combustion engine, in particular in the cold start phase, including unfavorable consumption values with irregular engine running. For this reason, a spiral torsion spring is provided between the rotor and the stator in the camshaft adjuster known from EP 1 979 582 B1. The torsion spring is suspended by a radially outer end on a projection assigned to the stator and by a radially inner end on a pin assigned to the rotor. The spiral spring is secured to the outside by a cover pressed into an annular cylindrical extension of the stator.

SUMMARY OF THE INVENTION

It is an object of the present invention to provide a camshaft adjuster, including a spiral-shaped torsion spring, which should be economical to manufacture and easy to mount.

The present invention provides that a plurality of axially projecting pins is provided on the rotor in a radially inner section of the vanes, the pins being situated on a radially inner section of the rotor and projecting through the torsion spring on the radially inner side of the innermost turn. Due to the proposed pins, a contour is provided for limiting the contracting movement of the torsion spring and for guiding the innermost turn of the torsion spring, with the aid of which the spring deformation is controlled and limited during the application of spring force. A contour is furthermore created with the aid of the pins, on which the inner end of the spring may be suspended in different positions, whereby the mounting may be facilitated and the spring pretension may also be varied.

BRIEF DESCRIPTION OF THE DRAWINGS

The present invention is explained in greater detail below on the basis of one preferred exemplary embodiment.

DETAILED DESCRIPTION

Figure 1:
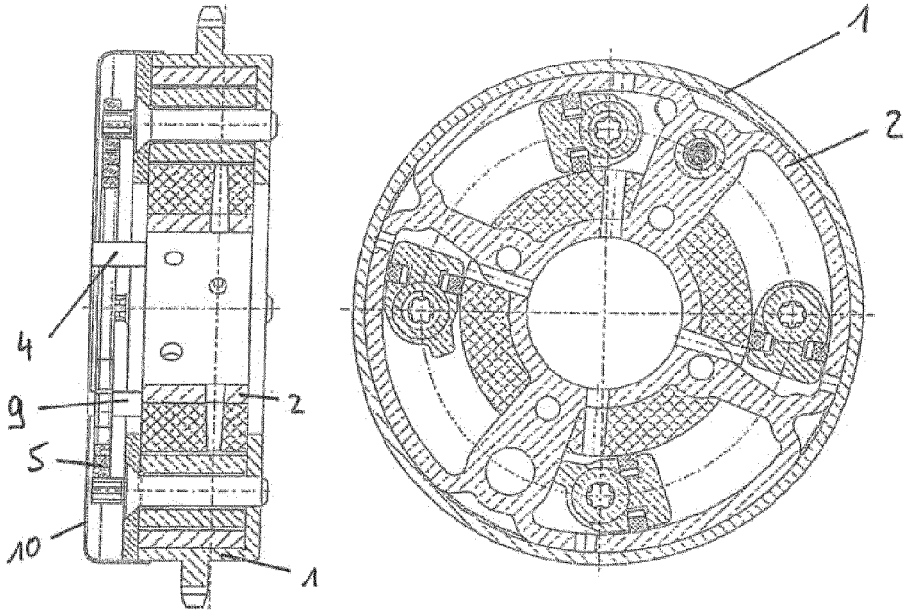
FIG. 1 shows different sectional views of a camshaft adjuster.

A camshaft adjuster designed according to the present invention is apparent in FIG. 1, which includes a cup-shaped stator 1 and a rotor 2, which is rotatably fixedly supported in stator 1. In its basic configuration, the camshaft adjuster has an identical design to the camshaft adjusters described in the publication EP 1 979 582 B1 or DE 100 24 760 A1, so that these publications are expressly to be added to the disclosure content of this application with regard to the disclosure of the operating principle of the camshaft adjuster. A plurality of vanes 11 is provided on rotor 2, which extend radially outward from an inner ring 12 of rotor 2.

A spiral torsion spring 5 is situated between stator 1 and rotor 2, which is held on a head of a fastening screw by outer spring end 8, the fastening screw holding together the stator assembly of stator 1, the stator webs and the sealing cover. Torsion spring 5 has a spiral design, including multiple turns situated in a plane and covered outwardly by a securing part 10 in the form of a cover pressed onto the sealing cover or stator 1. Four axially projecting pins 3, 4, 6 and 9, which are situated equidistantly from each other and equidistantly from the rotation axis of the rotor, are furthermore provided on the radially inner sections of vanes 11, which project through the radial inner side of the innermost turn of torsion spring 5 and thereby form a stop, which limits the contracting movement of the innermost turn of torsion spring 5. Since pins 3, 4, 6 and 9 are situated equidistantly from the rotation axis of rotor 2, they are located on a circle situated concentrically to the rotation axis of rotor 2 and thereby define the smallest radius to which the innermost turn of torsion spring 5 may contract. An additional spring force after the contraction of the innermost turn to this radius may thus take place only by deformation of the additional outer turns. Since pins 3, 4, 6 and 9 are situated equidistantly from each other, the adjacent, innermost turn of torsion spring 5 is evenly supported over the circumference in the contracted position. To situate pins 3, 4, 6 and 9, the radially inner sections of vanes 11 are provided with a sufficiently thick wall thickness, which is achieved by a thickening of vanes 11 which are thinner in the cross section.

Figure 2:
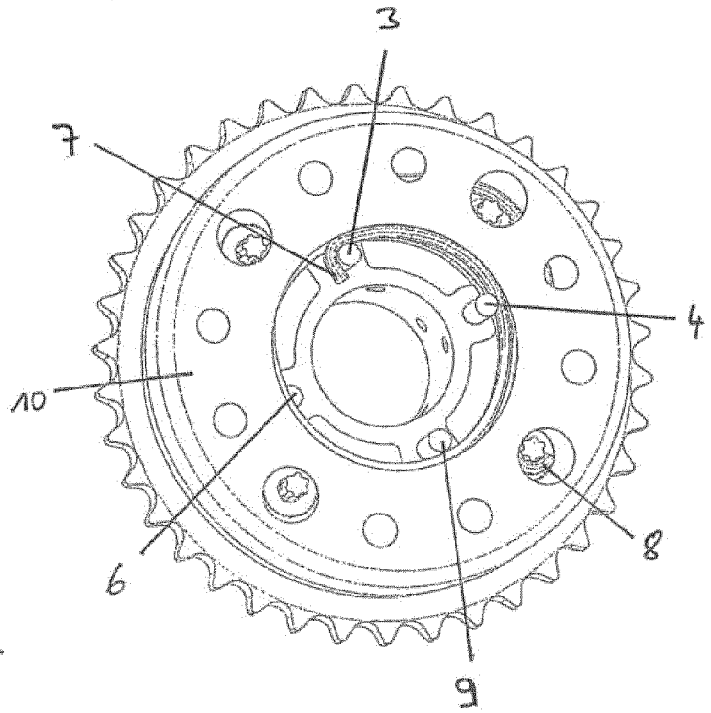
FIG. 2 show an oblique view of the spring side of the camshaft adjuster.

Pins 3, 4, 6 and 9 may furthermore also be used to hold inner spring end 7, as is apparent from pin 3 in FIG. 2. Spring end 7 may be suspended on different pins 3, 4, 6 or 9, whereby different pretensioning forces may be implemented.

Pins 3, 4, 6 and 9 are inserted into corresponding bores in the area of the vanes of rotor 2, so that the innermost turn of torsion spring 5, including bent spring end 7, are in each case held on a larger radius than the central opening of rotor 2, so that the central valve may be inserted into the opening of rotor 2 without blocking the insertion movement of torsion spring 5.

LIST OF REFERENCE NUMERALS

1 stator
2 rotor
3 pin
4 pin
5 torsion spring
6 pin
7 spring end
8 spring end

9 pin
10 securing part
11 vane
12 ring

What is claimed is:

1. A camshaft adjuster comprising:

a stator drivable by a crankshaft of an internal combustion engine;

a rotor rotatably fixedly connectable to a camshaft of the internal combustion engine, including multiple vanes projecting outward from a radially inner ring;

a torsion spring, operating between the rotor and the stator and having spiral turns, the torsion spring being connected indirectly or directly to the rotor with the aid of a first radially inner spring end and indirectly or directly to the stator with the aid of a second radially outer spring end, the torsion spring being situated on an axial front side of the rotor and the stator and being secured by a securing part covering the turns laterally toward the outside; and a plurality of axially projecting pins on the rotor on a radially inner section of the vanes, the pins being situated on a radially inner section of the rotor and projecting through the torsion spring on the radially inner side of the innermost turn; the radially inner section at least two of the vanes having a wall thickness thicker in cross-section than another section of the at least two vanes.

2. The camshaft adjuster as recited in claim 1 wherein the pins are situated equidistantly from the rotation axis of the camshaft adjuster.

3. The camshaft adjuster as recited in claim 1 wherein the pins are situated equidistantly from each other.

4. The camshaft adjuster as recited in claim 1 wherein the torsion spring is suspended by the inner spring end on one of the pins.

5. The camshaft adjuster as recited in claim 1 wherein the multiple vanes include four vanes.

6. The camshaft adjuster as recited in claim 5 wherein each of the four vanes has one of the plurality of axially projecting pins.

7. The camshaft adjuster as recited in claim 6 wherein the pins are situated equidistantly about the rotation axis of the camshaft adjuster from each other.

8. The camshaft adjuster as recited in claim 1 wherein the plurality of axially projecting pins includes four pins situated equidistantly about the rotation axis of the camshaft adjuster from each other.

* * * * *